United States Patent [19]

Arasmith

[11] 4,444,234

[45] Apr. 24, 1984

[54] LOG PROCESSING APPARATUS AND METHOD

[76] Inventor: Stanley D. Arasmith, P.O. Box 2458, Rome, Ga. 30164

[21] Appl. No.: 323,056

[22] Filed: Nov. 19, 1981

[51] Int. Cl.[3] ..... B27B 1/00

[52] U.S. Cl. ..... 144/370; 144/174; 144/208.6

[58] Field of Search ..... 144/162 R, 172, 174, 144/176, 218, 230, 208 G, 208 F, 369, 370

[56] References Cited

U.S. PATENT DOCUMENTS

| | | | |
|---|---|---|---|
| 1,456,328 | 5/1923 | Moravec . | |
| 1,619,151 | 3/1927 | Moravec . | |
| 1,853,664 | 4/1932 | Cummings . | |
| 2,378,980 | 6/1945 | Carlson | 125/11 |
| 2,400,825 | 5/1946 | Jakobsen | 125/11 |
| 2,484,583 | 10/1949 | Paulson | 51/134 |
| 2,591,893 | 4/1952 | Trippel | 51/219 |
| 2,671,480 | 3/1954 | Efurd . | |
| 2,682,996 | 7/1954 | Forman | 241/239 |
| 2,874,517 | 2/1959 | Markle | 51/34 |
| 2,889,859 | 6/1959 | Johnson | 144/176 |
| 2,891,588 | 6/1959 | Allen | 144/208 |
| 2,951,518 | 9/1960 | Compston, Jr. | 144/172 |
| 2,997,082 | 8/1961 | Schubert et al. | 144/230 |
| 3,028,891 | 4/1962 | Dillingham | 144/208 G |
| 3,104,500 | 9/1963 | Sheehan | 51/89 |
| 3,176,734 | 4/1965 | Broadbent | 144/208 G |
| 3,195,592 | 7/1965 | Hall | 144/172 |
| 3,209,801 | 10/1965 | Little et al. | 144/172 |
| 3,219,076 | 11/1965 | Logan et al. | 144/42 |
| 3,240,245 | 3/1966 | Johnson | 144/176 |
| 3,267,976 | 8/1966 | Keeney | 144/208 G |
| 3,285,305 | 11/1966 | Nicholson | 144/208 |
| 3,304,970 | 2/1967 | Altosaar | 144/162 |
| 3,324,909 | 6/1967 | McCranie | 144/162 R |
| 3,394,744 | 7/1968 | Vit | 144/162 |
| 3,559,705 | 2/1971 | Salzmann, Jr. | 144/162 |
| 3,732,907 | 5/1973 | Nystrom et al. | 144/176 |
| 3,746,062 | 7/1973 | Nystrom et al. | 144/176 |
| 3,907,016 | 9/1975 | Nicholson . | |
| 4,077,450 | 3/1978 | Ackerman . | |

OTHER PUBLICATIONS

"Chipper Disk," FFV pp. 1-5.

"Pulpwood Production & Saw Mill Logging" Mar. 1973, pp. 32 & 33.

*Primary Examiner*—W. D. Bray

*Attorney, Agent, or Firm*—Jones & Askew

[57] ABSTRACT

A method and apparatus of processing logs prior to further processing in lumber, plywood, pulp or veneer mills. In the apparatus, logs are deposited into a cradle formed between a rotating cutter drum and support rollers which guide the log against the cutting drum and rotate the log about its longitudinal axis in a direction opposite to the rotation of the cutter drum, at a controlled speed slower than the drum. Constant rotation of the log reduces horsepower requirements by minimizing the length of each cut made by cutter assemblies extending from the cutter drum. Logs are discharged by lowering the guide rollers with respect to the cutter drum. A second embodiment is disclosed including a pair of cooperating rollers providing a variable sized cradle adjacent to the cutter drum. Means for delivering logs to the apparatus and for removing material cut from the log are disclosed. In a single operation, logs are debarked, rounded, reduced to any desired diameter, or completely reduced to chips.

15 Claims, 9 Drawing Figures

10
11
12
40
50
51
52
53
55
56
57
59
63
65
67
68
72
74
78
79
80
81
83
85
88
2
2

LOG PROCESSING APPARATUS AND METHOD

TECHNICAL FIELD

The present invention relates to apparatus for processing newly harvested logs prior to further processing into finished products, and more particularly relates to an apparatus for debarking, rounding, sizing and chipping logs.

BACKGROUND ART

When logs are harvested from the forest, the logs are used in many processes. Particular logs may be bound for lumber mills, pulp mills, plywood mills or veneer mills. Many logs are crooked, oversized or have irregularities that make them unsuitable for use in such processes. Bark must be removed before precision chips are produced and before a log can be processed by a veneer lathe. Logs must be uniformly round for the production of usable veneer in a veneer lathe, and can be more efficiently packed in shipping containers or vats for soaking and steaming the logs if the logs are round. Round logs are also required for certain end uses such as posts or poles. It may be desirable to convert a log completely into chips for use in the production of pulp or particle board.

In the past, the debarking, rounding, sizing and chipping operations have generally been carried out on separate machines. This practice has been inefficient in terms of energy use, time, and labor.

Prior debarking apparatus has included ring-type debarkers like that shown in U.S. Pat. No. 3,285,305. In such machines a log passes through a ring fitted with scrapers that rotate around the log rapidly and remove the bark as the log passes through the ring. A disadvantage of ring-type debarkers is that the diameter of the ring restricts the maximum size log that can be processed. The process is time consuming because the scrapers do not work along the entire length of the log simultaneously. Also, the log handling apparatus provided with ring debarkers often cannot handle logs under a certin length. Another type of debarker is the slitter-disc, as shown in U.S. Pat. No. 2,891,588. Debarking has also been accomplished by rossing or abrading rollers, as shown in U.S. Pat. No. 1,619,151, by tossing a number of logs inside a drum having scrapers or abrading heads mounted on the interior wall of the drum, and by machines which remove the bark by causing a rossing or abrading head to traverse the length of the log back and forth as the log is slowly rotated.

Rounding of crooked logs and reducing their diameter to a size acceptable in further processing steps has been accomplished using a veneer lathe. It has been necessary to precenter the log in a lathe charger by engaging the opposite ends of the log with spindles or the like, and placing the log into the veneer lathe to remove radially protruding portions from the log so that it will be round in shape prior to the actual removal of usable veneer sheets. It can be difficult to accurately center or locate the axis of the log when engaging the ends thereof, and therefore excessive amounts of wood may be removed by the lathe in attempting to shape the log before the veneer sheets can be cut. Furthermore, during this process the knife of the veneer lathe engages the log along a lengthy path, and therefore requires large amounts of energy to remove waste material from the log.

Many prior devices have been developed for reducing logs to chips. A widely used device propells the log end-on at an angle into a rotating disk upon the face of which are mounted cutter knives. Examples of such devices are shown in U.S. Pat. Nos. 3,732,907 and 3,746,062. Logs have also been propelled against cutter knives protruding from the exterior of rotary drums, both end-on, as shown in U.S. Pat. Nos. 3,285,305, 3,304,970 and 3,394,744, or along the length of a log, as shown in U.S. Pat. No. 2,951,518. Yet another type of chipping apparatus provides a rotating head which chips away the side of the log as the log moves longitudinally past the head, as shown in U.S. Pat. Nos. 2,889,859 and 3,240,245. A disadvantage common to all such prior chippers is that the cutter knives traverse long paths through the logs. Thus, the devices have large horsepower requirements to provide the cutter knives with sufficient surge and force to carry them through the log. In most prior chippers, the cutter knives must, at some point in the consumption of the log, traverse the full diameter of the log.

A further typical disadvantage of prior debarkers, chippers and rounding apparatus is a necessity for complex and expensive log handling equipment required to guide the logs into engagement with the operative cutting or abrading elements, and to remove the processed log or chips therefrom. The nature of the handling apparatus or the operative cutting or abrading elements often limits the maximum diameter of logs that can be processed. Cutter knives which must make long cuts each time they engage the wood have relatively short lives and must be repeatedly replaced. Thus, there has been a need in the art for an apparatus capable of efficiently debarking, rounding, sizing and chipping logs harvested from the forest.

SUMMARY OF THE INVENTION

The present invention provides a single log processing apparatus that can provide all the above-described operations on harvested logs. The invention provides rotary knife means and means for continuously changing the orientation of wooden members being processed by the knife means such that the path of travel of the knife means through a wooden member is maintained below a desirable length. This results in significant energy savings by reducing horsepower requirements, without sacrifice of production speed.

Somewhat more particularly described, the present invention is a log processing apparatus for debarking, rounding, sizing and chipping logs, comprising a cylindrical member including a plurality of cutters arrayed along the length of the cylindrical member and extending outwardly from the surface thereof; means for rotating the cylindrical member about its longitudinal axis; and means engaging the circumferential surface of a log for guiding the log against the cylindrical member along essentially the entire length of the log, and for rotating the log about its longitudinal axis at a controlled speed, preferably slower than the cylindrical member.

It will thus be seen that the present invention also provides a method of removing material from the exterior surface of the log, comprising the steps of guiding the log into longitudinal engagement with a cylindrical member including a plurality of cutters arrayed along the length of the cylindrical member and extending outwardly therefrom; rotating the cylindrical member about its longitudinal axis such that the cutters engage the log and remove material therefrom; and rotating the log about its longitudinal axis at a controlled speed. The log is preferably rotated in a direction opposite to the direction of the cylindrical member, at a speed less than that of the cylindrical member.

In a preferred embodiment, the means for guiding the logs against the cylindrical member and rotating the logs comprises a plurality of toothed wheels mounted adjacent to the cylindrical member along a driven shaft. Further apparatus is provided to permit the driven shaft and tooth wheels to be positioned to provide a log-receiving cradle between the toothed wheels and the cylindrical member, and to be selectively dropped with respect to the cylindrical member to discharge the logs after processing. Means can be provided for varying the speed of rotation of the driven shaft and therefore to vary the speed of rotation of the log with respect to the speed of the cutter knives on the cylindrical member. Log infeed means is provided for depositing a log between the toothed wheels and the cylindrical member, and chip collection means is provided below the cylindrical member and the toothed wheels for receiving material removed from the log by the cutters. The chip collection means can be provided with a gate valve operable to direct bark removed from a log into one collection area and chips removed from the log into another collection area. The cutter knives are preferably helically arrayed about the surface of the cylindrical member, and overlap axially along the cylindrical member so that material can be removed from the entire surface of a log in one rotation thereof. The amount of material removed during a single rotation can be adjusted by adjusting the speed of rotation of the log as compared to the speed of rotation of the cylindrical member.

In another embodiment of the invention, the log processing apparatus comprises a horizontally disposed cylindrical member including a plurality of cutters arrayed along the length of the cylindrical member and extending outwardly from the surface thereof; means for rotating the cylindrical member about its longitudinal axis; and means engaging the circumferential surface of a log for guiding the log against the cylindrical member along essentially the entire length of the log, such means comprising first roller means rotatable about an axis extending parallel to the longitudinal axis of the cylindrical member and below the horizontal plane thereof; second roller means rotatable about a movable axis extending parallel to the longitudinal axis of the cylindrical member at a greater distance than the axis of the first roller means, the second roller means being linked to the first roller meaans so as to be movable in an arcuate path about the axis of the first roller means; means for rotating the first and second roller means in synchronization so as to cause a log engaging the roller means to rotate at a controlled speed slower than the cylindrical member; and means for selectively moving the second roller means in an arcuate path about the axis of the first roller means, upwardly to urge the log against the cylindrical member, and downwardly to discharge the log. This second embodiment of the invention is particularly useful in rounding logs which are larger toward one end of the log than at the other end, because the log tends to rest upon the first roller means while the second roller means urges the larger diameter portion of the log into the cutters prior to substantial engagement of the thinner end with the cutters. Like the first embodiment of the invention generally described above, the second embodiment requires relatively non-complex log infeed and discharge apparatus and chip collection means. It will also be noted that the embodiments of the present invention can accept all logs without restriction as to their diameter, require lower horsepower than prior devices, and extend the lifetime of cutter knives utilized in accordance with the invention.

Thus, it is an object of the present invention to provide an improved apparatus for processing logs harvested from the forest prior to further processing of such logs in lumber, pulp, plywood or veneer mills.

It is a further object of the present invention to provide a wood processing apparatus capable of debarking, rounding and sizing logs in a single operation.

It is a further object of the present invention to provide a wood processing apparatus capable of either debarking and rounding logs or reducing such logs to wood chips.

It is a further object of the present invention to provide a debarking, rounding and chipping apparatus which processes logs quickly, yet has low horsepower requirements.

It is a further object of the present invention to provide a debarking, sizing and chipping apparatus operable so as to extend the life of cutter knives utilized in the apparatus.

It is a further object of the present invention to provide a debarking, sizing and chipping apparatus which has no upper limit on the diameter of logs that can be processed by the apparatus.

It is a further object of the present invention to provide a log processing apparatus that can debark and size a log, and selectively provide the log with a smooth or a patterned surface.

It is a further object of the present invention to provide a log processing apparatus that can remove material from the entire surface of a log in one revolution of the log.

Other objects, features and advantages of the present invention will become apparent upon reading the following detailed description of embodiments of the invention, when taken in conjunction with the drawing and the appended claims.

BRIEF DESCRIPTION OF THE INVENTION

DETAILED DESCRIPTION

Figure 1:
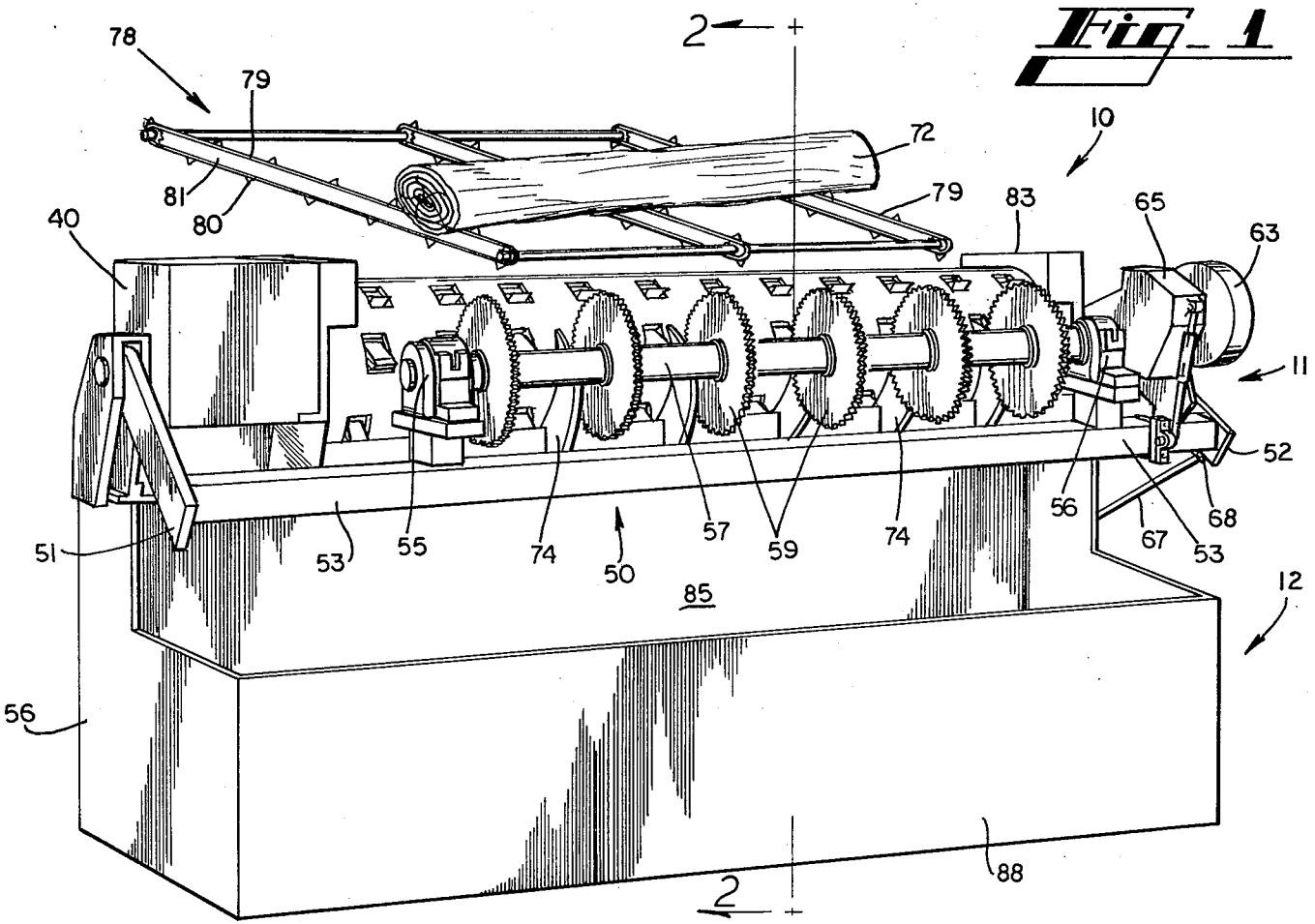
FIG. 1 is a front perspective view of a log processing apparatus embodying the present invention.

Referring now in more detail to the drawing, in which like reference numerals refer to like parts throughout the several views, FIG. 1 shows a log processing apparatus 10 embodying the present invention. The log processing apparatus 10 includes a log processing means generally indicated as 11, mounted above a chip and bark collection means generally indicated as 12.

Figure 4:
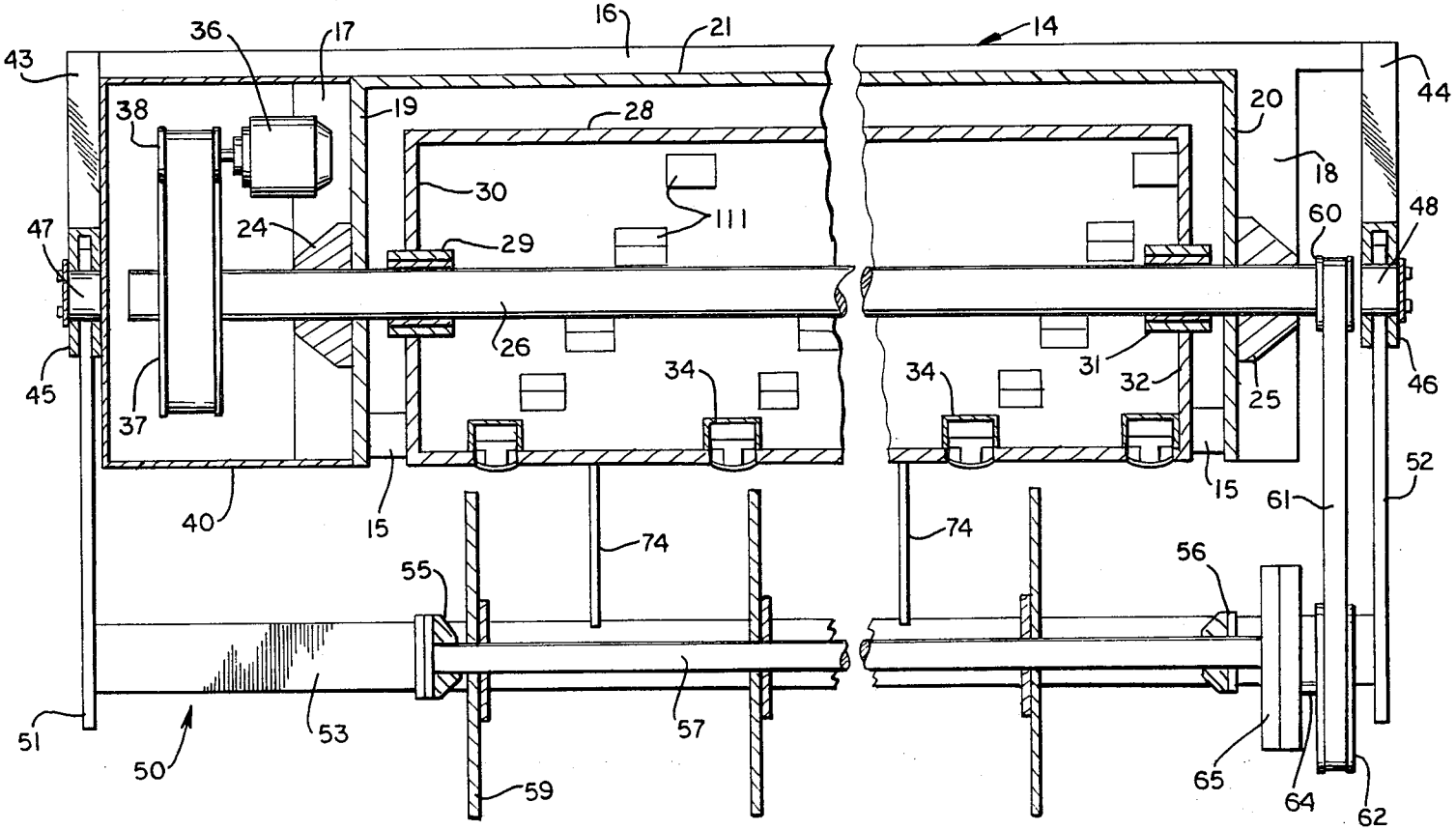
FIG. 4 is a horizontal cross-sectional view of the log processing apparatus of FIGS. 1-3, taken along line 4—4 of FIG. 2.

The log processing means 11 includes a rectangular drum support frame 14 best shown in FIG. 4, which includes a front beam 15, a parallel rear beam 16, and side beams 17 and 18 connecting the front and rear beams. Extending upwardly from the side beams 17 and 18 are side walls 19 and 20, respectively. A rear wall 21 extends upwardly from the rear beam 16 and connects the side walls 19 and 20.

Conventional heavy duty bearings are mounted adjacent colinear openings in the side walls 19 and 20. A drum drive shaft 26 is journaled for rotation within the bearings 24 and 25 and extends outwardly through the side walls 19 and 20. A cylindrical member or drum 28 is mounted about the drive shaft 26 by sleeves 29 and 31 pressed between the shaft 26 and end walls 30 and 32, respectively, of the drum 28. The shaft 26 thus passes through the drum and forms the longitudinal axis of rotation of the drum 28. The drum 28 further includes a plurality of cutter assemblies 34 extending outwardly from the outer circumferential surface of the drum 28. The cutter assemblies 34 will be described in further detail below.

Figure 2:
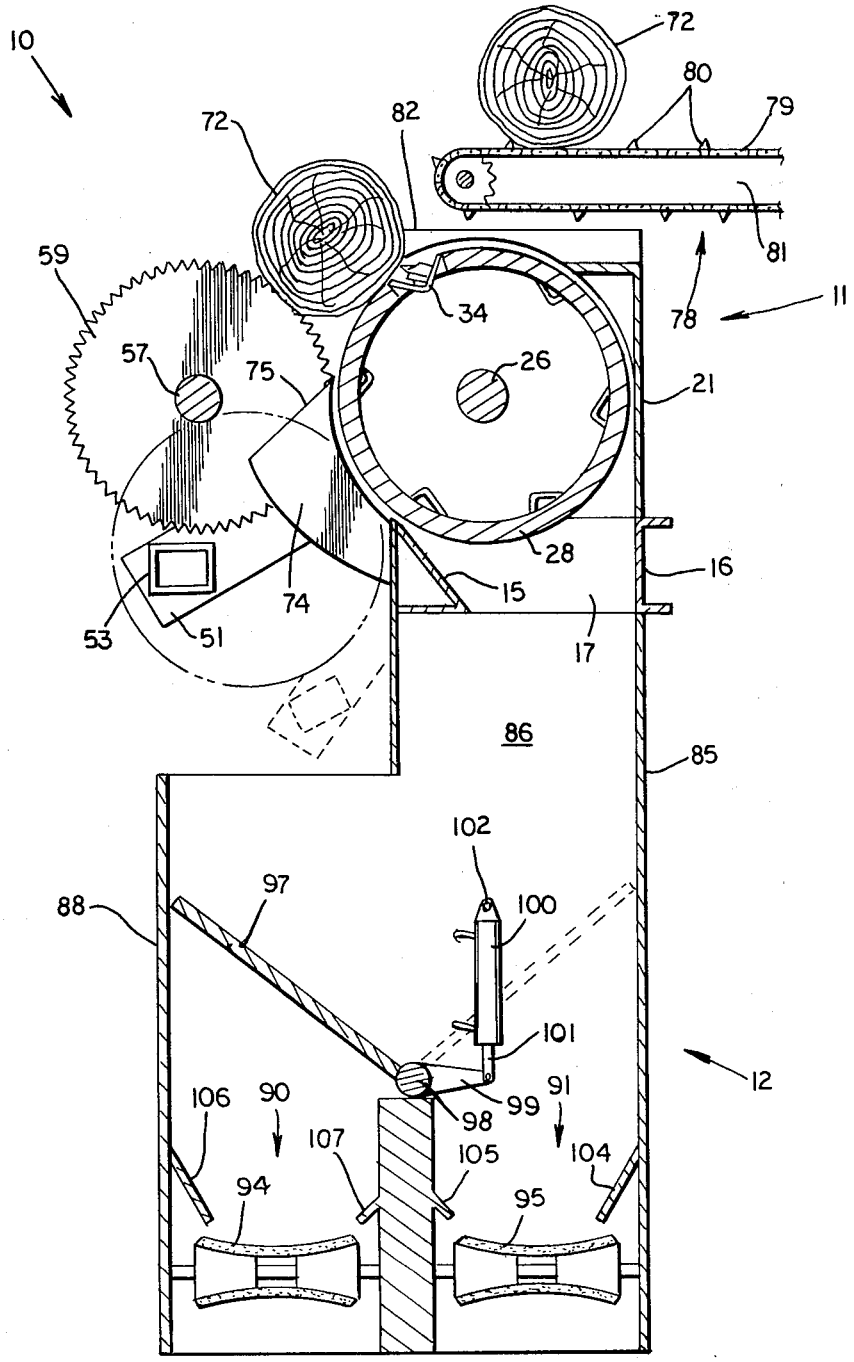
FIG. 2 is a vertical cross-sectional view of the log processing apparatus shown in FIG. 1, taken along line 2—2 of FIG. 1.

The drive shaft 26 and drum 28 are driven in a counterclockwise direction as viewed in FIG. 2, by an electric motor 36 mounted on the side beam 17 of the frame 14, as shown in FIG. 4. It will be understood that any conventional means for rotating the shaft 26 can be substituted for the electric motor 36. A shaft pulley 37 fixed to the shaft 26 is connected to a motor pulley 38 by a belt 39, the motor pulley 38 being driven by the motor 36. The motor 36 and pulleys 38 and 37 are enclosed by a motor housing 40.

As is best shown in FIG. 4, the rear beam 16 of the frame 14 extends in both directions beyond the side beams 17 and 18. The rear beam 16 extends beyond the side beam 17 to a point beyond the shaft pulley 37 and the end of the shaft 26. To the opposite extending ends of the rear beam 16 there are attached a pair of support members 43 and 44 which extend diagonally upwards and define yokes 45 and 46 positioned colinearly with the drive shaft 26. Pivot axles 47 and 48, colinear with the shaft 26, are associated with the yokes 45 and 46.

A log guiding and rotating means 50 extends forwardly from the support members 43 and 44, and adjacent to the front of the frame 14. A pair of side arms 51 and 52 are rotatably received within the yokes 45 and 46 about the pivot axles 47 and 48, respectively. At their forwardly extending ends, the side arms 51 and 52 are joined by a cross beam 53 which is preferably a box beam for strength, as shown in FIG. 2. A pair of colinear bearings 55 and 56 are mounted on the beam 53 and spaced above the beam 53. The bearing 55 is approximately adjacent to the end wall 30 of the drum 28, and the bearing 56 is approximately even with the end wall 32 of the drum 28. A roller drive shaft 57 is journaled for rotation within the bearings 55 and 56. A plurality of rollers 59 comprising toothed wheels are attached at their centers to the roller drive shaft 57 in spaced apart relation from one another between the bearings 55 and 56. The toothed circumferential edges of the rollers 59 extend to a point closely adjacent to the surface of the drum 28, preferably within about one inch.

The roller drive shaft 57 is driven by take off from the drum drive shaft 26. A shaft pulley 60 is fixed to the drum drive shaft 26 outside the bearing 25. A belt 61 connects the shaft pulley 60 to a drive pulley 62, which is connected to the input shaft 64 of a conventional variable speed drive 65. The output shaft of the variable speed drive 65 is drivingly connected to the roller drive shaft 57. The variable speed drive 65 is selected to permit the roller drive shaft 57 and rollers 59 to be driven at various speeds lower than the rotational speed of the drum drive shaft 26, and in a counterclockwise direction as viewed in FIG. 2. The pulleys 60 and 62 and the belt 61 are protected by a housing 63.

Figure 3:
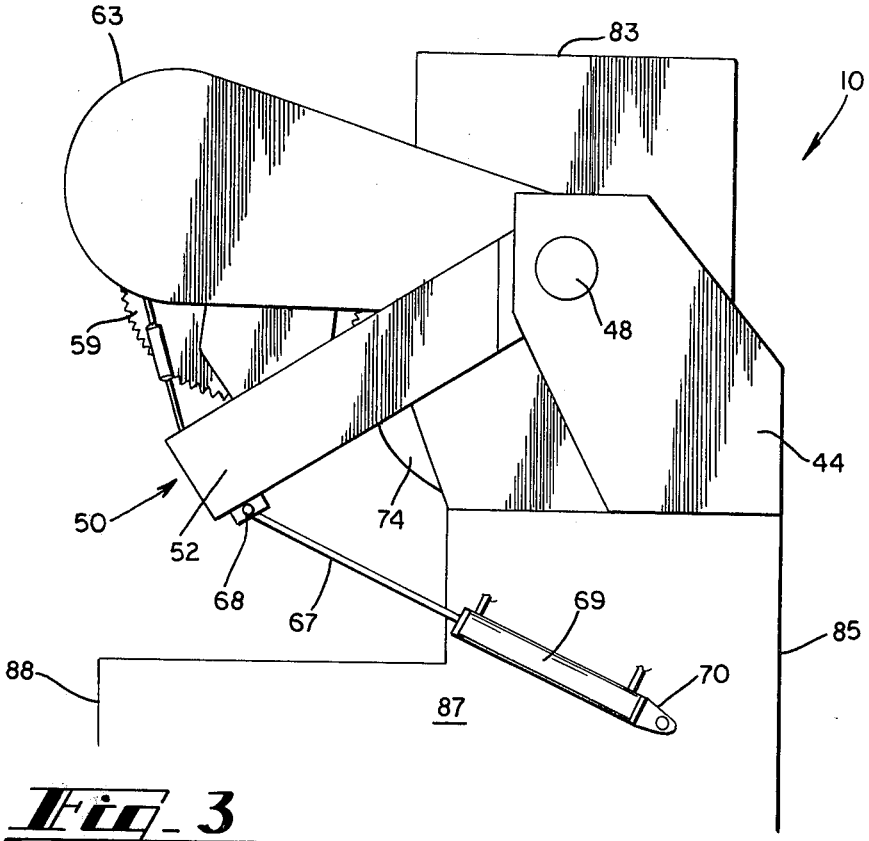
FIG. 3 is a partial side plan view of the log processing apparatus of FIG. 1.

As best shown in FIG. 3, the log guiding and rotating means 50 can be pivoted through an arcuate path about the pivot axles 47 and 48 by means of an extendable and retractable rod 67 pivotally attached at 68 to the side arm 52. A means for extending the rod 67, such as a hydraulic cylinder 69, is pivotally attached at 70 to the chip collection means 12. Extension of the rod 67 raises the toothed wheels 59 to an upper position shown in FIG. 2, in which the toothed wheels 59 and the drum 28 form a cradle therebetween for receiving logs. A log 72 is shown cradled between the toothed wheels 59 and the drum 28 in FIG. 2. When the rod 67 is retracted into the cylinder 69, the toothed wheels 59 are lowered to a position shown in dashed lines in FIG. 2. In the lower most position of the toothed wheels 59, logs previously cradled between the toothed wheels 59 and the drum 28 can be discharged from the apparatus. To assist in the discharge of logs from the apparatus, a plurality of log discharge guides 74 are provided extending from the front beam 15 of the frame 14 upwardly and outwardly between the toothed wheels 59. The log discharge guides 74 are preferably constructed of vertically oriented metal plates, and define a discharge ends 75 extending from adjacent to the outer surface of the drum 28 at an incline downwardly away from the drum. However, the guides 74 do not extend so far as to interfere with the arcuate motion of the box beam 53 and the roller drive shaft 57. When the toothed wheels 59 are lowered, a log supported thereby will engage the guide surface 75 of the log discharge guides 74 and slide downwardly and outwardly over the lowered toothed wheels 59 into a receptacle (not shown) from which they are transferred for further processing, if desired.

As shown in FIGS. 1 and 2, a log infeed means 78 is provided for depositing logs into the cradle formed between the toothed wheels 59 and the drum 28. The log infeed means 78 includes a chain conveyor 79, extending from the rear of the log processing means 11 over the vertical centerline of the drum 28. The chain 79 includes spaced apart spike links 80 which separate logs which are placed upon the chain conveyor by conventional means. The chain 79 travels around a chain guide 81 which supports the chain over the drum 28. The chain guide 81 is supported by further appropriate conventional structural members (not shown). To further guide logs being deposited into the log processing means 11, the ends of the drum 28 are received within sturdy shrouds 82 and 83 at opposite ends of the drum. The shrouds 82 and 83 serve to restrain any tendency of a log to move longitudinally beyond the longitudinal range of the cutter assemblies 34.

The log processing means 11 is mounted to rest upon the chip and bark collection means 12, as shown in FIGS. 1 and 2. The chip collection means 12 comprises an L-shaped bin substantially open to receive bark and chips removed from the log 72 by the cutter assemblies 34. The bin is defined by a rear wall 85 which supports the rear beam 16, side walls 86 and 87, which support the side beams 17 and 18, and a front wall 88 that is lowered with respect to the rear wall 85 so as not to obstruct the arcuate movement of the log guiding and rotating means 50. The side walls 86 and 87 are also cut away at their upward forward corners to provide space for movement of the log guiding and rotating means 50.

The chip and bark collection means 12 is divided longitudinally into a bark collection area 90 and a chip collection area 91 by a central longitudinal wall 92 extending between the side walls 86 and 87. A conventional belt conveyor 94 is mounted in the bark collection area 90 around a plurality of rollers extending between the front wall 88 and the central wall 92. The conveyor 94 carries materials landing thereon to a suitable receptable (not shown). A second conventional belt conveyor 95 extends longitudinally in the chip collection area 91 about rollers extending between the back wall 85 and the central wall 92. Materials landing on the conveyor 95 are carried to another receptacle (not shown). A gate valve 97 is provided within the collection means 12 for diverting the material removed from a log by the cutter assemblies 34 to either the conveyor 94 or the conveyor 95. The gate valve 97 extends longitudinally across the collection means 12, and is rotatable with a longitudinally extending shaft 98 located directly above the central wall 92. The shaft 98 is journaled in bearings (not shown) in the side walls 86 and 87. A crank arm 99 operates the shaft 99 by means of a hydraulic cylinder 100 the piston rod of which is pivotally connected to the end of the crank arm 99 at 101. The cylinder 100 is pivotally connected to the side wall 86 at 102. As shown in FIG. 2, the gate valve 97 is shown in its forward position so as to divert chips falling from the log processing means 11 into the chip collection area 91 for transportation by the conveyor 95. Longitudinally extending baffles 104 and 105 extend from the rear wall 85 and the central wall 92 to overlap the edges of the conveyor 95 so that all of the chips are guided onto the conveyor. When the piston rod of the cylinder 100 is extended, the gate valve 97 moves to its rearward position shown in dashed lines in FIG. 2. In this position, material removed by the cutter assemblies 34 is guided into the bark collection area 90 and onto the conveyor 94. Longitudinally extending baffles 106 and 107, similar to the baffles 104 and 105, assure that all of the material is deposited on the conveyor 94.

Figure 5:
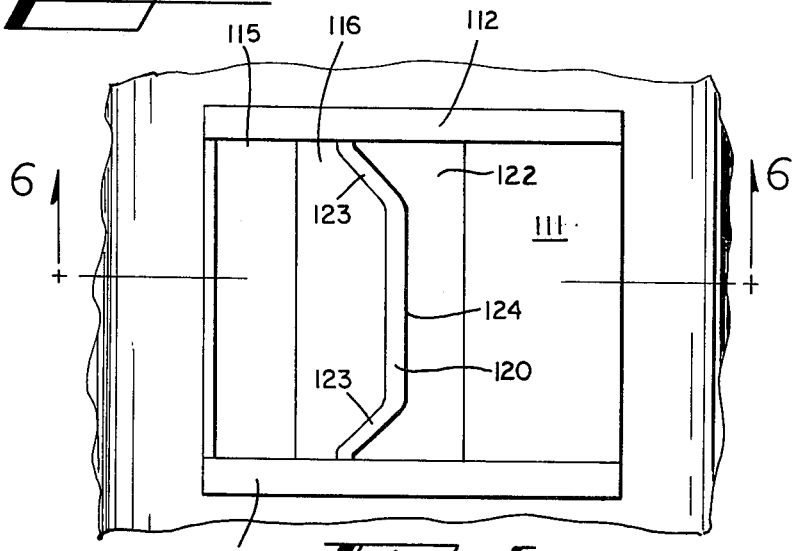
FIG. 5 is a front plan view of a cutter assembly utilized in the log processing apparatus of FIG. 1.
Figure 6:
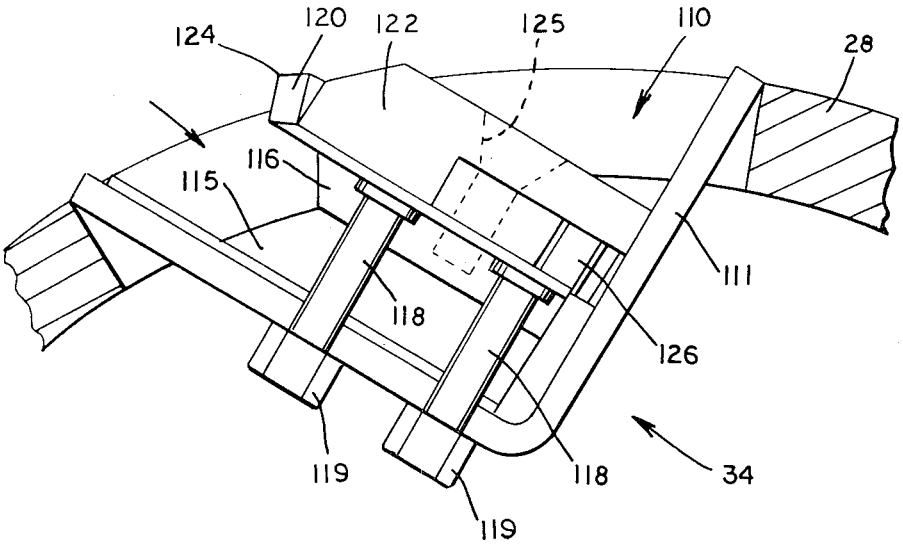
FIG. 6 is a side cross-sectional view of the cutter assembly of FIG. 5, taken along line 6—6 of FIG. 5.
Figure 7:
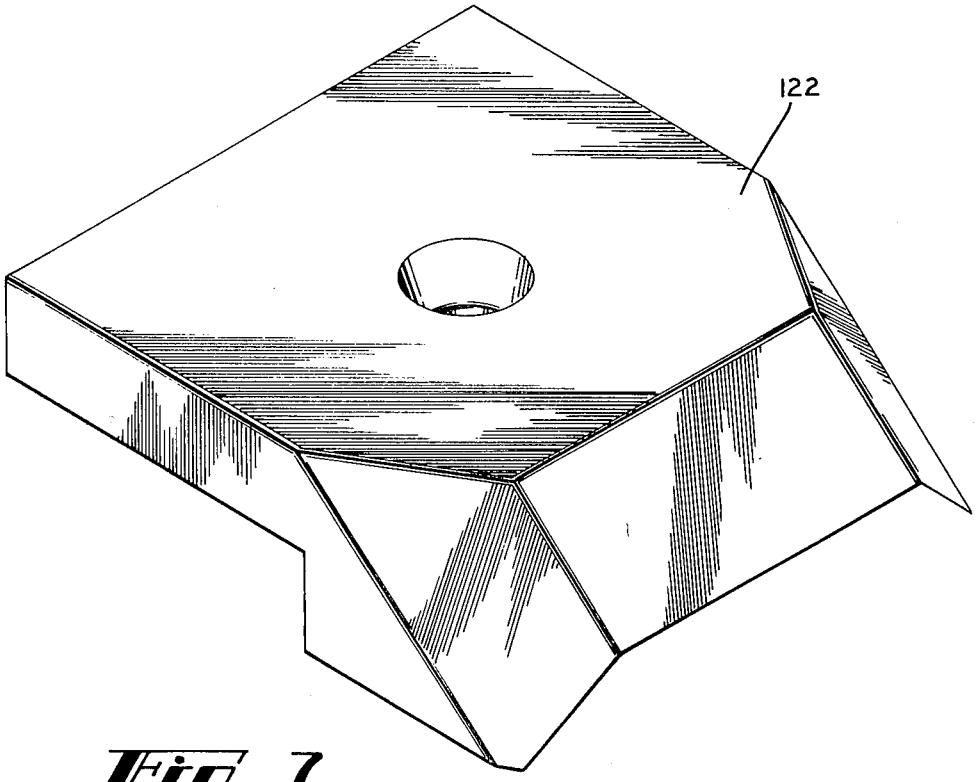
FIG. 7 is a perspective view of a knife clamping member utilized in the cutter assembly of FIGS. 5 and 6.

The cutter assemblies 34, shown in detail in FIGS. 5–7, are mounted in recesses 110 extending into the cylindrical surface of the drum 28. The recesses 110 are defined by L-shaped members 111, the ends of which are attached to the cylindrical surface of the drum along axial seams, and by side walls 112 and 113 extending between the surface of the drum and the sides of the L-shaped member 111. A pair of gullet blocks 115 and 116 are positioned on the bottom surface of the recess 110 formed by one leg of the L-shaped member 111. The outwardly extending end of the gullet block 115 is angled inwardly, and the outwardly extending end of the gullet block 116 is angled outwardly, to form a gullet 117 in the lower outer portion of the recess 110. The gullet blocks 115 and 116 are held in place by bolts 118, the heads of which are recessed in the gullet block 116, and the ends of which extend into nuts 119 on the side of the L-shaped member 111 within the drum 28. A knife 120 having a profile shown in FIG. 5 rests upon the gullet block 116 and is clamped in place thereon by a knife clamp 122, the shape of which is shown individually in FIG. 7. The knife 120 is formed by bending downwardly side portions of a rectangular plate to form wings 123. The plate forming the knife 120 is then sharpened at the upper edge 124. The shape of the knife provided cuts a properly shaped chip suitable for further processing. A machine screw 125 extends through the knife clamp 122 into a tapped opening in the gullet block 116 to clamp the knife 120 firmly in position. However, the knife 120 is provided with a slot (not shown) surrounding the screw 125, and a space 126 is provided under the knife clamp 122 behind the knife 120 so that if the knife strikes a hard object embedded in a log, the knife will slide backward under the knife clamp 122, and thereby avoid serious damage to the knife or the apparatus.

The sharpened end of the knife 120 extends slightly beyond the outer circumferential surface of the drum 28. The gullet 117 is thus formed by the lower protruding surface of the knife 120, the gullet blocks 115 and 116, and the L-shaped member 111. Chips or bark cut away from a log by the knife 120 are collected in the gullet 117 until they are dropped from the gullet into the chip and bark collection means 12 described above.

Operation of the embodiment of the invention shown in FIGS. 1–6 will be substantially apparent from the above-description of the apparatus 10. Initially, the gate valve 97 is placed in its dashed line position in FIG. 2, to guide materials removed from a log into the bark receiving area 90. Also, the toothed wheels 59 are raised to an upper position by extension of the rod 67. Operation of the cylinder 69 is accomplished by a hydraulic control system of a type well known to those skilled in the art. The variable speed drive 65 is set for a desired speed of rotation of the toothed wheels 59 and a log 72 engaged thereby. A log is deposited onto the log infeed conveyor 79, and the conveyor is operated to deposit the log into the cradle formed between the toothed wheels 59 and the drum 28. The motor 36 is started, thereby rotating the drum 28 and the toothed wheels 59 in a counterclockwise direction in FIG. 2. The rotation of the toothed wheels 59 causes the log 72 to rotate at a controlled speed in a clockwise direction. Rotation of the drum 28 causes the knives 120 to cut away pieces of bark from the exterior of the log 72. If the log is rotating sufficiently slowly, the overlapping axial positions of the cutter assemblies 34 as shown in FIG. 1 will result in bark being removed from the entire surface of the log in one revolution of the log. Furthermore, continuous rotation of the log by the toothed wheels 59 results in material being removed evenly from the outer surface of the log and prevents the cutters from cutting deep into the log from one position around its circumference.

Once the bark is removed, the gate valve 97 is shifted to its solid line position in FIG. 2, so that chips of the now exposed wood of the log will be guided into the chip collection area 91. Action of the knives 120 continues evenly around the surface of the log, so that as material is removed from the log the log becomes rounded. Cutting can continue until the log is perfectly round and has been reduced in diameter to any desired size. It will be understood that the log can be completely consumed by chipping by simply continuing to operate the apparatus. If processing by the apparatus 10 is completed when the log is still in log form, the log is discharged by lowering the toothed wheels 59, causing the log to engage the discharge guides 74, and to be guided thereby downwardly over the rollers 59 and into an appropriate receptacle or conveying device (not shown) for transporting the log for further processing.

It will further be understood that the continuous rotation of the log by the toothed wheels 59 results in the knives 120 consistently traveling only a short distance through the outer surface of the log. Therefore, the motor 36 can supply less horsepower than has been required in prior chipping devices in which the log was held stationary and simply urged toward a cutting device. It has been found that a motor providing less than fifty horsepower is required to operate an apparatus as shown in FIG. 1, in which the toothed wheels 59 and the drum 28 are about two feet in diameter. The efficiency of the machine also results in a lower noise level and longer life for the knives before they require resharpening. Any size log may be deposited between the toothed wheels and the drum. It will be noted that in the operation just described, pror art processes that have been accomplished by separate machines, namely, debarking, rounding, sizing and chipping, are all accomplished by one apparatus embodying the present invention. A reversible variable speed drive can be provided as the variable speed drive 65, and the toothed wheels 59 can be rotated in a clockwise direction to alternately operate the device as a rapid rotary chipper. However, this causes the knife cuts to be longer and utilizes more energy. In the normal mode, when the log is rotating in a clockwise direction and the cutter knives in a counterclockwise direction, the speed of rotation of the log can be adjusted so that the cutter knives consistently cut through a shoulder created by a previous cut. This is a very efficient type of cut which requires lower horsepower. Control of the speed of the toothed wheels 59 also permits control of the nature of the surface created on the log. If the log is rotated slowly with respect to the speed of rotation of the drum, then the multiple cuts made during a revolution of the log will produce a smooth surface. If a patterned or rough surface is desired on the log, the speed of rotation of the log with respect to the cutting knives can be speeded up by adjusting the variable speed drive 65. It has been found preferable to rotate the toothed wheels 59 at a speed one-third or less that of the drum 28 for most operations.

Although the present apparatus can be manufactured on any appropriate scale, it has been found that a drum having a diameter between 24 and 30 inches is practical and efficient to operate. The toothed wheels can be of the same diameter as the drum, or can be larger or smaller. If it is known that relatively small logs will be processed consistently, then the diameter of the toothed wheels can be reduced to create a shallower cradle between the toothed wheels and the drum.

As an alternative to the gate valve and dual conveyor system shown in the chip and bark collection means 12, a single reversible conveyor can be provided. Thus, in place of changing the position of a gate valve when sufficient bark has been removed from the log, the direction of the reversible conveyor is changed. Appropriate receptacles or conveyors (not shown) for carrying out the bark and chips to further processing equipment are placed at opposite ends of the reversible conveyor.

Figure 8:
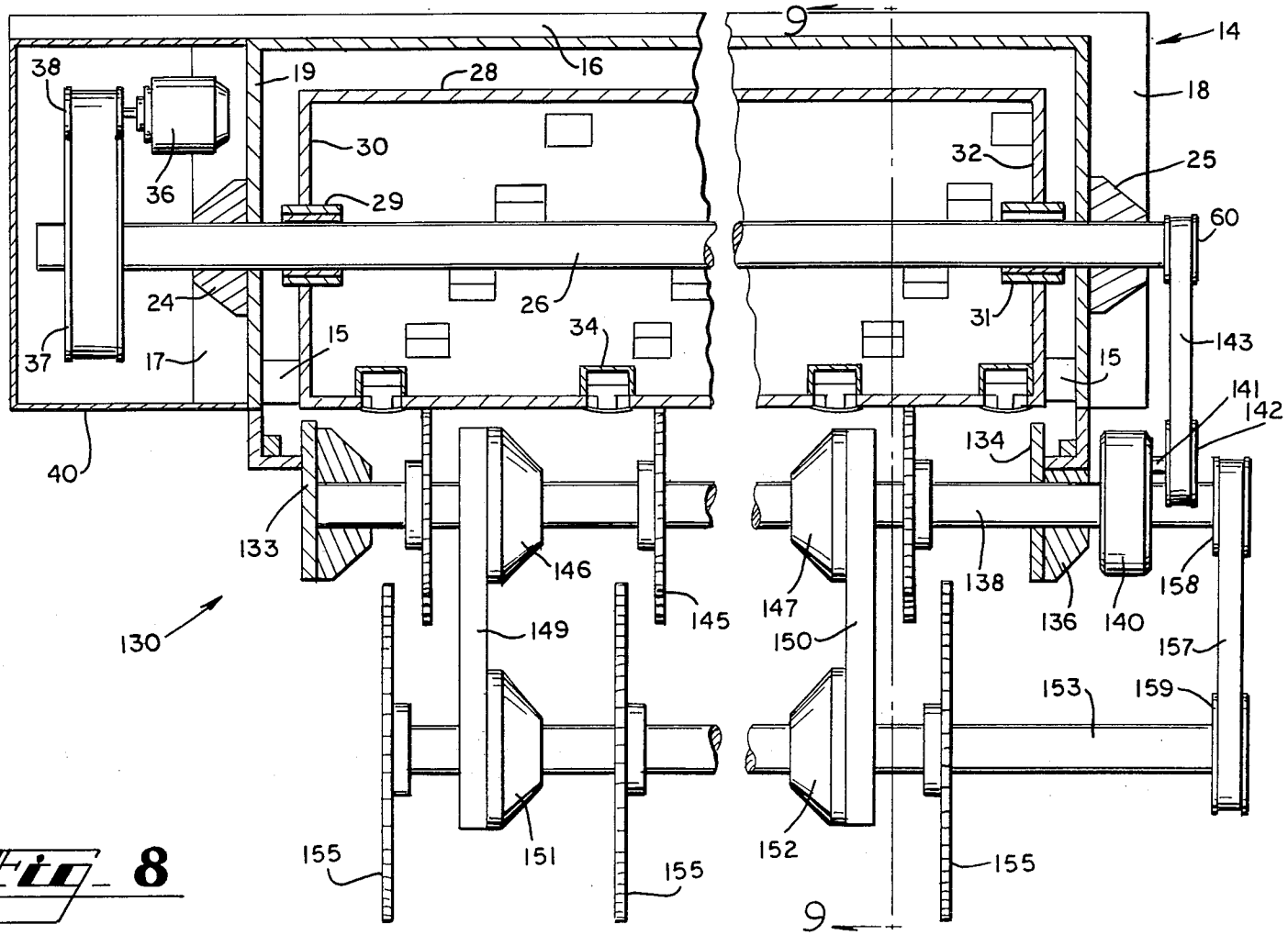
FIG. 8 is a horizontal cross-sectional view of a second embodiment of the present invention.
Figure 9:
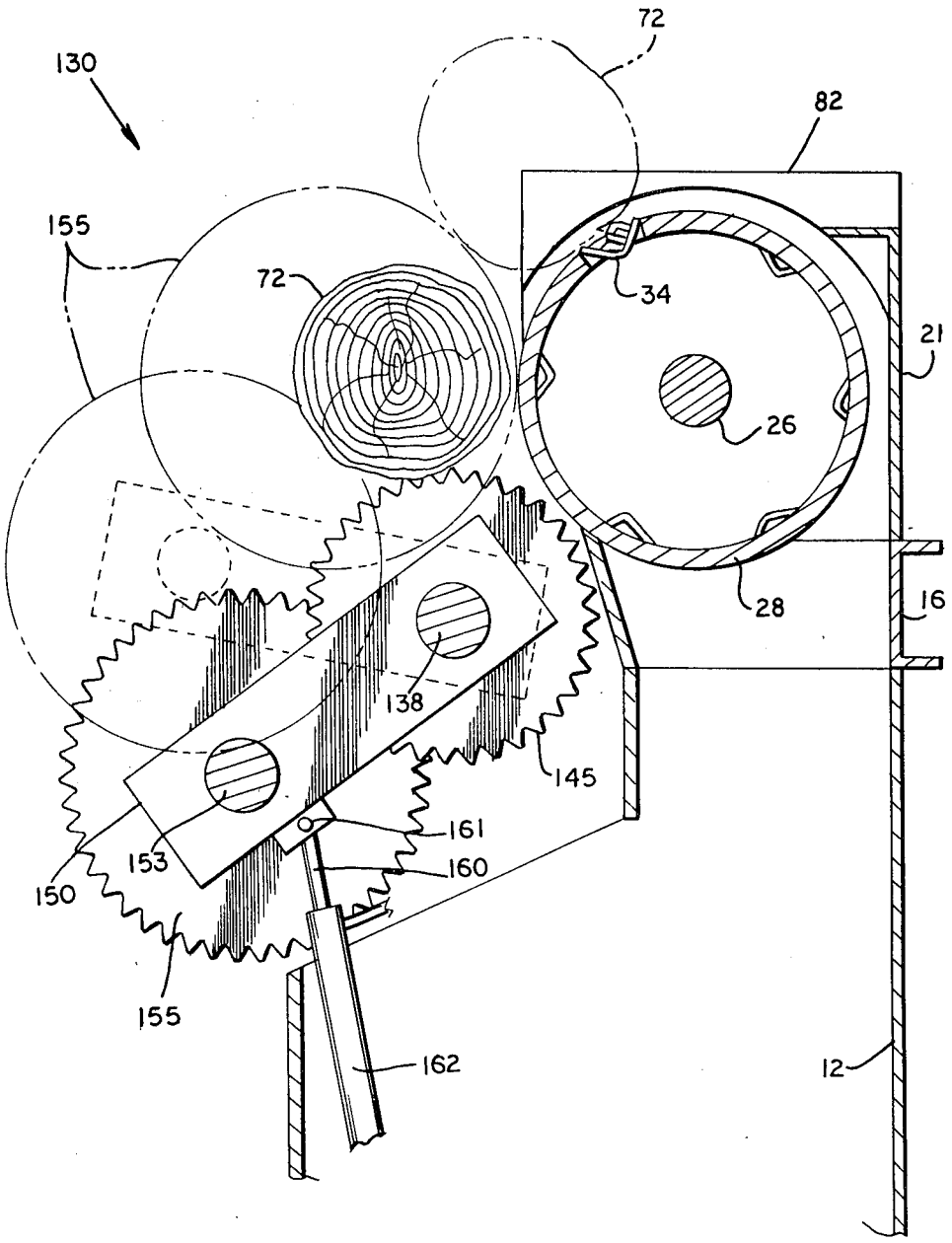
FIG. 9 is a vertical cross-sectional view of the log processing apparatus shown in FIG. 8, taken along line 9—9 of FIG. 8.

A second embodiment of the present invention in a log processing apparatus 130 is shown in FIG. 8, which is a horizontal cross-sectional view similar to that shown in FIG. 4 for the first embodiment. A vertical cross-sectional view of the apparatus 130 is shown in FIG. 9. In the second embodiment of FIGS. 8 and 9, the frame 14 and supporting and drive structure for the drum 28 and shaft 26 are similar to that for the first embodiment shown in FIGS. 1–4. However, a modified means 132 for guiding and rotating logs is provided. Support extensions 133 and 134 extend forwardly from the side walls 19 and 20 and carry colinear bearings 135 and 136 positioned below the shaft 26. A first roller drive shaft 138 is journaled for rotation through the bearings 135 and 136, and extends to be drivingly connected to the output shaft of a variable speed drive 140. The input shaft 141 of the variable speed drive 140 is driven by a drive pulley 142 that is drivingly connected to the shaft pulley 60 of the drum drive shaft 26 by a belt 143. The first roller drive shaft 138 has mounted thereon in spaced apart relation a plurality of toothed wheels 145 similar to the toothed wheels 59 of the first embodiment. Between the toothed wheels 145 a pair of spaced apart bearings 146 and 147 are journaled for rotation about the shaft 138. The bearings 146 and 147 are mounted on one end of respective connecting members 149 and 150. The connecting members 149 and 150 extend outwardly away from the drum 28 and carry, at their extending ends, another pair of bearings 151 and 152, respectively. A second roller drive shaft 153 is journaled for rotation within the bearings 151 and 152. The shaft 153 has mounted thereon a plurality of spaced apart toothed wheels 155 similar to the toothed wheels 145 and 59. The toothed wheels 155 preferably are about equal in diameter to the toothed wheels 145.

In addition to the connecting members 149 and 150, the roller drive shafts 138 and 153 are connected by a belt 157 which drivingly connects a shaft pulley 158 mounted at the end of the shaft 138, and a shaft pulley 159 mounted at the end of the shaft 153. Thus, the variable speed drive 140 drives both sets of toothed wheels 145 and 155 in synchronization in the same direction. It will also be seen that bearings 146, 147, 151 and 152 permit the second roller drive shaft 153 to be moved in an arcuate path about the first roller drive shaft 138. This is accomplished by extension and retraction of a rod 160 pivotally connected at 161 to one of the connecting members 149, 150. The rod 160 can be extended or retracted by a hydraulic cylinder 162, appropriately mounted to the chip and bark collection means 12.

Alternately, the wheels 145 can be smaller than the wheels 155, as shown in FIG. 9, but in this case the size of the pulley 159 must be increased to equalize the speed of the respective teeth at the circumference of the wheels 145 and 155.

Log infeed means and material collection means similar to that provided for the first embodiment are provided to complete the second embodiment, and therefore are not shown in detail in FIGS. 8 and 9. Extension of the rod 160 rotates the shaft 153 about the shaft 138, while the shaft 138 remains fixed in position with respect to the drum 28. In its upper most position, the shaft 153 positions the toothed wheels 155 immediately adjacent to the drum 28. In this upper most position, shown in dashed lines in FIG. 9, the second embodiment can function in a manner identical to that of the first embodiment. When the rod 160 is partially retracted, the toothed wheels 155 are placed in an intermediate position also shown in dashed lines in FIG. 9, wherein the toothed wheels 155 and 145 form a broad cradle between the toothed wheels and the drum 28. Since the toothed wheels rotate in synchronization, the log is rotated as described in connection with the first embodiment. However, the rod 160 can be extended during processing of the log, such that the second set of toothed wheels 155 is raised and urges the log toward the drum 28. A particular advantage of the second embodiment is that any log which is thicker at one end than at the other is urged toward the drum 28 so that the thicker end engages the drum prior to the thinner end. Thus the log can be rounded efficiently without removal of unnecessary material at the thin end of the log. Apart from the variable sized cradle provided by the linked sets of toothed wheels 145 and 155 for supporting and rotating logs adjacent to the drum 28, operation of the second embodiment shown in FIGS. 8 and 9 is essentially similar to operation of the first embodiment shown in FIG. 1.

From the foregoing, it will be understood by those skilled in the art that the present invention provides significant improvements and advantages over prior apparatus and methods for debarking, rounding, sizing and chipping logs. An apparatus embodying the present invention does not merely combine known techniques for debarking with those for rounding, sizing and chipping, but provides a new apparatus which accomplishes all necessary functions prior to further processing of a log in, for example, veneer mill, in a single operation. Thus, the present invention results in significant time savings as well as energy efficiencies. Flexibility is also provided in that no maximum diameter or minimum length is placed on logs capable of being processed in an apparatus embodying the invention. Furthermore, tramp material which is embedded in the log or falls between the log and the cutter drum is disposed of quickly without damaging the apparatus because such material falls easily into the collection bin 12, avoiding costly damage and down time.

While this invention has been described in detail with particular reference to preferred embodiments thereof, it will be understood that variations and modifications can be effected within the spirit and scope of the invention as described hereinbefore and as defined in the appended claims.

I claim:

1. A log processing apparatus comprising:

an elongate cylindrical drum rotatably mounted about a horizontal longitudinal axis thereof and including a plurality of cutters arrayed along the length of said cylindrical drum and extending outwardly from the surface thereof;

means for rotating said cylindrical drum about its longitudinal axis;

a plurality of toothed rollers positioned beside said drum such that the periphery of said rollers is positioned closely adjacent to the surface of said drum, said roller peripheries and said drum surface supporting said log and defining a log-receiving cradle therebetween, and means for rotating said rollers so as to rotate said log.

2. The apparatus of claim 1 wherein said cutters comprise a central linear cutting edge and a pair of wing cutting edges extending at an obtuse angle from the ends of said central cutting edge.

3. The apparatus of claim 1, wherein said cutters are arrayed helically about the surface of said elongate cylindrical drum.

4. The apparatus of claim 1 wherein said means for rotating said rollers comprises means for rotating said rollers in the same direction as the rotation of said cylindrical drum at a speed slower than said drum.

5. The apparatus of claim 1 wherein said means for rotating said rollers further comprises means for varying the speed of rotation of said log about its longitudinal axis.

6. The apparatus of claim 1, further comprising log infeed means for depositing a log in said log-receiving cradle between said toothed rollers and said elongate cylindrical drum.

7. The apparatus of claim 1, further comprising chip collection means positioned below said toothed rollers and said elongate cylindrical drum for receiving material removed from said log by said cutters.

8. The apparatus of claim 7, further comprising gate valve means positioned within said chip collection means for selectively guiding material removed from said log into one of a plurality of collection areas.

9. The apparatus of claim 1, further comprising a means for selectively moving said rollers from an upper position generally equal to or higher than said drum to a lower position generally lower than said drum.

10. The apparatus of claim 9, further comprising a plurality of log discharge guides extending downwardly at an incline between said rollers away from said drum, said discharge guides guiding said log away from said drum when said rollers are in said lower position.

11. A method for removing material from the exterior surface of a log, comprising the steps of:

supporting said log in a log-receiving cradle defined between the surface of an elongate cylindrical drum and the peripheries of a plurality of toothed rollers positioned closely adjacent to the surface of said drum, said drum including a plurality of cutters arrayed along the length of said drum and extending outwardly therefrom;

rotating said elongate cylindrical drum about its longitudinal axis in a first direction such that said cutters engage said log and remove material therefrom; and rotating said log by rotating said plurality of toothed rollers.

12. The method of claim 11, wherein said log is rotated in a second direction opposite to said first direction.

13. The method of claim 11, wherein said log is rotated at a speed less than the rotational speed of said elongate cylindrical drum.

14. An apparatus for debarking, rounding, sizing, and chipping logs comprising:

a horizontally disposed cylindrical drum including a plurality of cutters arrayed along the length of said elongate cylindrical drum and extending outwardly from the surface thereof;

means for rotating said elongate cylindrical drum about its longitudinal axis; and means engaging the circumferential surface of a log for guiding said log against said elongate cylindrical drum along essentially the entire length of said log comprising:

a first plurality of toothed rollers rotatable about an axis extending along the longitudinal axis of said elongate cylindrical drum and below the horizontal plane of said drum axis;

a second plurality of toothed rollers rotatable about a movable axis extending about said longitudinal axis of said elongate cylindrical drum at a greater distance therefrom than the axis of said first plurality of toothed rollers;

means for rotating said first and second rollers in synchronization so as to cause a log engaging said rollers to rotate in a direction opposite to the rotation of said elongate cylindrical drum at a speed slower than said elongate cylindrical drum; and means for selectively moving said second plurality of toothed rollers from an upper position generally equal to or higher than said drum to a lower position generally lower than said drum.

15. The apparatus of claim 14, wherein said means for selectively moving said second plurality of toothed rollers comprises hydraulic cylinder means.

* * * * *